US005586641A

United States Patent [19]

Leifeld

[11] Patent Number: 5,586,641

[45] Date of Patent: Dec. 24, 1996

[54] APPARATUS FOR FEEDING SLIVERS TO A DRAWING FRAME

[75] Inventor: Ferdinand Leifeld, Kempen, Germany

[73] Assignee: Trützschler GmbH & Co. KG, Mönchengladbach, Germany

[21] Appl. No.: 391,276

[22] Filed: Feb. 21, 1995

Related U.S. Application Data

[63] Continuation-in-part of Ser. No. 278,147, Jul. 21, 1994, abandoned.

[30] Foreign Application Priority Data

Jul. 22, 1993 [DE] Germany ..... 43 24 540.4

[51] Int. Cl.[6] ..... B65G 19/00

[52] U.S. Cl. ..... 198/720; 198/580; 198/733

[58] Field of Search ..... 198/580, 717, 198/720, 721, 723, 725, 728, 733

[56] References Cited

U.S. PATENT DOCUMENTS

| | | | |
|---|---|---|---|
| 905,268 | 12/1908 | Young et al. | 198/733 X |
| 2,570,264 | 10/1951 | Nordquist et al. | 198/733 |
| 2,630,202 | 3/1953 | Saxe | 198/580 |
| 3,079,979 | 3/1963 | Flood | 198/580 X |
| 3,198,316 | 8/1965 | Bivans | 198/728 X |
| 3,869,042 | 3/1975 | Floyd et al. | 198/721 X |
| 4,434,701 | 3/1984 | Voillot | 198/580 X |
| 4,642,851 | 2/1987 | Hera . | |
| 5,101,983 | 4/1992 | Scata | 198/733 X |

FOREIGN PATENT DOCUMENTS

| | | |
|---|---|---|
| 343047 | 5/1978 | Austria . |
| 0212979 | 3/1987 | European Pat. Off. . |
| 0509201 | 10/1992 | European Pat. Off. . |
| 1291663 | 3/1969 | Germany . |
| 3922522 | 1/1991 | Germany . |
| 4112322 | 10/1992 | Germany . |
| 4130463 | 3/1993 | Germany . |
| 937517 | 9/1963 | United Kingdom . |
| 937518 | 9/1963 | United Kingdom . |
| 1029898 | 5/1966 | United Kingdom . |
| 1270832 | 4/1972 | United Kingdom . |
| 1386573 | 3/1975 | United Kingdom . |
| 1519869 | 8/1978 | United Kingdom . |

*Primary Examiner*—James R. Bidwell
*Attorney, Agent, or Firm*—Spencer & Frank

[57] ABSTRACT

An apparatus for advancing sliver-filled coiler cans into a position at a sliver-intake side of a drawing frame and for removing empty coiler cans from that position, includes an endless track having a first track portion including the position; a second track portion; two arcuate deflecting track portions interconnecting the first and second track portions at opposite ends thereof; an endless circulating transporting chain extending along the endless track; and a plurality of spaced can pusher arms mounted on the chain and extending therefrom to individually engage a coiler can and advancing each can on the endless track as the chain circulates, whereby the pusher arms advance the coiler cans on the first track portion in a first direction and on the second track portion in a second direction. There is further provided a can retaining device for preventing the cans from leaving the deflecting track portions during travel thereon.

22 Claims, 5 Drawing Sheets

1.1
1.2
1.3
21
22
L
1.1
23
18
17
1'
2
35
15
1''
14
11
1.1
21
1.2
1.3
M
1.3
22

FIG. 5a
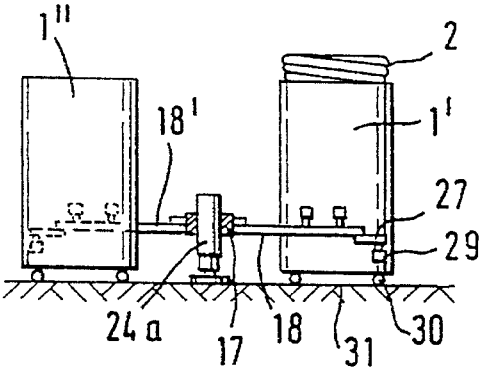
FIG. 5b
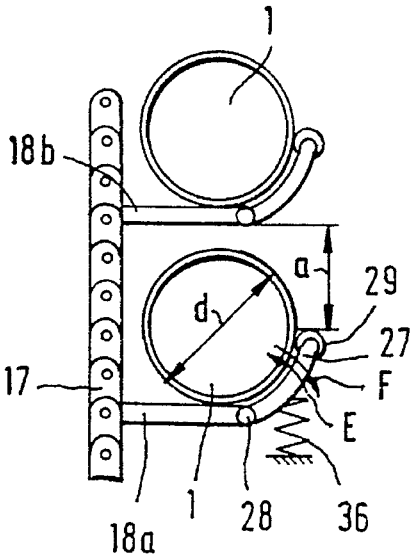
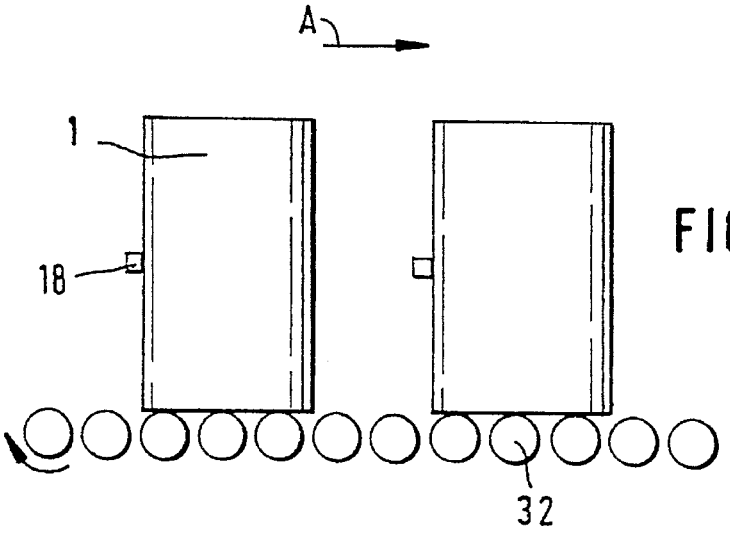
FIG. 6

APPARATUS FOR FEEDING SLIVERS TO A DRAWING FRAME

This application is a continuation-in-part, of application Ser. No. 08/278,147, filed Jul. 21, 1994, now abandoned.

CROSS REFERENCE TO RELATED APPLICATION

This application claims the priority of German Application No. P 43 24 540.4 filed Jul. 22, 1993, which is incorporated herein by reference.

BACKGROUND OF THE INVENTION

This invention relates to an apparatus for introducing slivers to a drawing frame in a spinning preparation plant. The drawing frame pulls the slivers from individual coiler cans positioned in sliver removal emplacements, while the slivers are guided on support rollers to the drawing frame. The apparatus includes a can guiding system which has pusher arms mounted on an endless conveyor chain. Each arm engages a coiler can and advances the same in a predetermined direction.

In a known apparatus such as a drawing frame intake rack there is provided a channel which ensures space for a row of passing coiler cans and a full standby can which are advanced in a direction opposite to the direction of sliver run from the cans. Through an inlet which adjoins the location of the full standby can, further standby cans may be presented from a standby channel to that end of the can row which is oriented towards the drawing frame. Through an outlet which adjoins the can with the least sliver content, the empty can is added from the channel to that can row end which is remote from the drawing frame. The cans are advanced by the can guiding system intermittently or continuously until they arrive at the end of the channel. The fill level of the cans decreases stepwise from the channel inlet to the channel outlet. The supply of full cans occurs on the same side of the channel where the cans to be depleted are located. It is a disadvantage of such an arrangement that the spatial requirements are high and it is a further drawback that a simultaneous supply and removal of a plurality of cans or all the full end empty cans is not possible. It is furthermore not feasible to effect an exchange of all coiler cans (a so-called block exchange) on one side of the conveyor chain. It is yet another disadvantage of the prior art constructions that only a single empty can is present which is pushed out of the channel and only a single full can is present which is introduced into the channel. Also, only one longitudinal side of the chain is utilized for the coiler can conveyance.

SUMMARY OF THE INVENTION

It is an object of the invention to provide an improved apparatus of the above-outlined type from which the discussed disadvantages are eliminated and which, in particular, has significantly reduced spatial requirements and permits a simultaneous supply and removal of a plurality of coiler cans into and out of the working position (channel).

This object and others to become apparent as the specification progresses, are accomplished by the invention, according to which, briefly stated, the apparatus for advancing sliver-filled coiler cans into a position at a sliver-intake side of a drawing frame and for removing empty coiler cans from that position, includes an endless track having a first track portion including the position; a second track portion; two arcuate deflecting track portions interconnecting the first and second track portions at opposite ends thereof; an endless circulating transporting chain extending along the endless track; and a plurality of spaced can pusher arms mounted on the chain and extending therefrom to individually engage a coiler can and advancing each can on the endless track as the chain circulates, whereby the pusher arms advance the coiler cans on the first track portion in a first direction and on the second track portion in a second direction. There is further provided a can retaining device for preventing the cans from leaving the deflecting track portions during travel thereon.

By means of the holding elements the coiler can is, in the region of the reversal of travel direction (that is, where the coiler can is advanced in a "U-turn") guided by the carriers (can pusher elements) on an arcuate path without the risk of escaping the arcuate path (that is, without "breaking out" of the turn). Thereafter the coiler can arrives at the parallel longitudinal side of the chain on which it is further advanced by the can pusher elements. In this manner, a "block exchange" of the coiler cans is feasible. Simultaneously, all empty cans and all standby full cans may be delivered in a simple manner to opposite sides of the chains. Furthermore, the apparatus, by utilizing both longitudinal sides of the chain, is structurally simple and significant space saving may be achieved. While on one longitudinal side of the chain the coiler cans may be depleted, on the other longitudinal side at the same time, for example, by means of a can transport carriage, empty cans may be removed and full cans may be brought in.

Expediently, the transporting chain circulates about two vertical axles. At opposite ends of the transporting chain (that is, at locations of reversals or U-turns) the chain path is expediently of semicircular shape. At the end regions an arcuate holding element, such as a holding (guiding) rail is provided which is concentric with the respective vertical axles. At the opposite ends (reversal zones) of the conveyor chain a driven rotary platform is arranged on which the coiler cans stand. The rotary platform has stabilizing elements, for example, depressions for receiving the coiler cans to prevent them from breaking out of their circular path. At the open ends of the can pusher elements (pusher arms) movable holding elements are provided. The holding elements support the coiler cans during their transport in the space between the pusher arms and permit a removal or entry of the coiler cans from or into the space between consecutive pusher arms. The holding elements are expediently spring loaded. One end of the holding elements is rotatable in a rotary bearing and a roller is mounted on the outer end of the holding element. Expediently, the holding elements are leaf springs. Expediently, the coiler cans are provided with bottom rollers for travel on the plant floor. Expediently, the coiler cans have no bottom rollers in which case a transport device for the coiler cans is provided. The transport device includes a roller track and/or is provided with a conveyor belt.

BRIEF DESCRIPTION OF THE DRAWINGS

FIG. 5*a* is a schematic end elevational view of the construction shown in FIG. 3.

FIG. 5*b* is a fragmentary top plan view of a modification of the structure shown in FIG. 3.

FIG. 6 is a fragmentary schematic side elevational view of coiler cans shown on a roller track.

DESCRIPTION OF THE PREFERRED EMBODIMENTS

Figure 1:
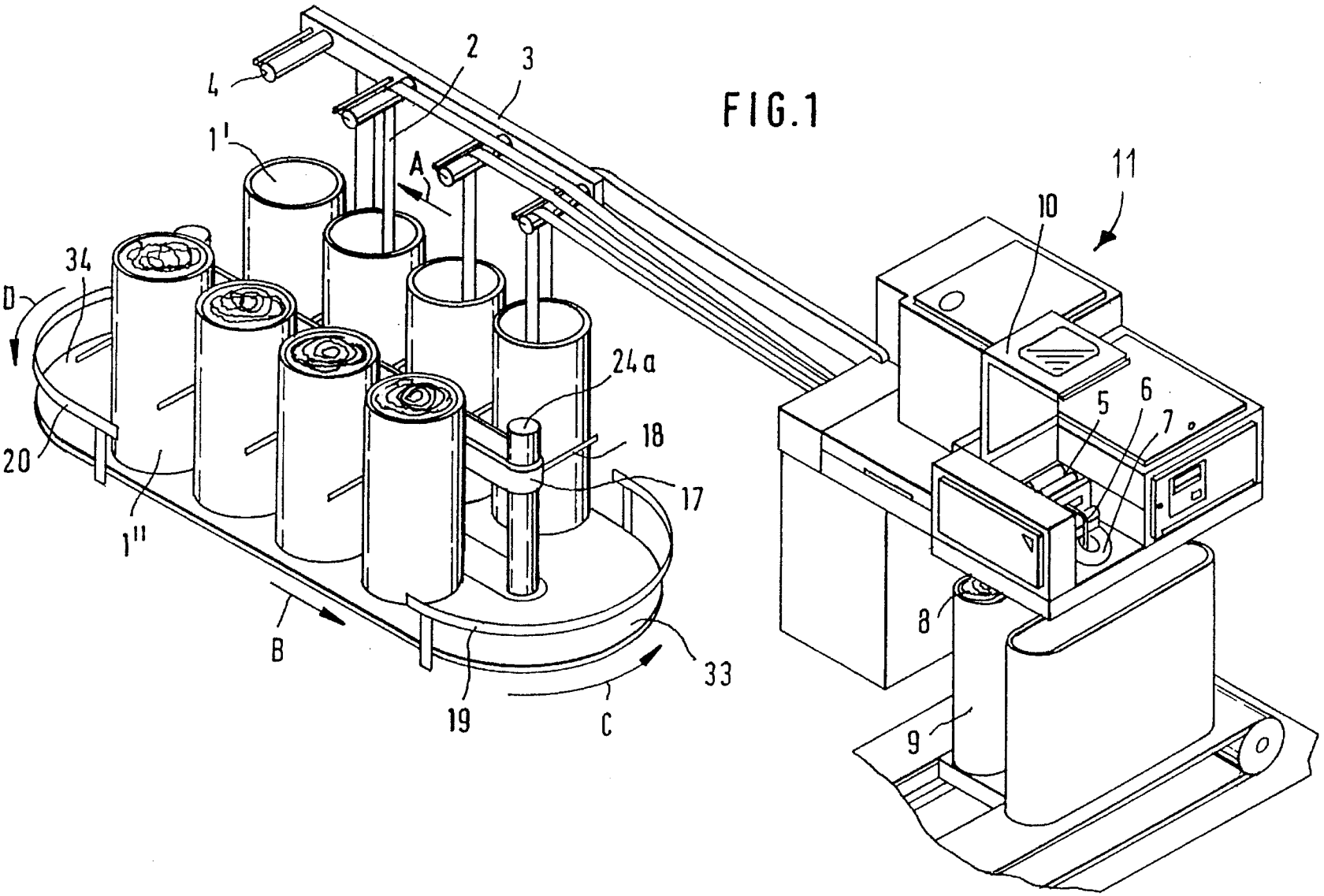
FIG. 1 is a schematic perspective view illustrating a drawing frame incorporating the invention.

Turning to FIG. 1, there is illustrated therein a drawing frame generally designated at 11 which may be, for example, a high-production drawing frame of the model HS 900 manufactured by Trützschler GmbH & Co. KG, M önchengladbach, Germany. The cylindrical coiler cans 1 from which slivers 2 are introduced into the drawing frame 11 are situated underneath the sliver inlet arrangement (inlet rack) 3. The slivers 2 pass over support rollers 3 of the inlet rack and are introduced into the drawing unit 5 of the drawing frame. The drawing unit 5 stretches the slivers 2 and combines them into an output sliver 6 which is introduced into a rotary coiler head 7 for depositing the sliver 6 in coils 8 in flat coiler cans 9. The drawing unit 5 and the coiler head 7 are protected by a drawing frame cover 10.

Figure 3:
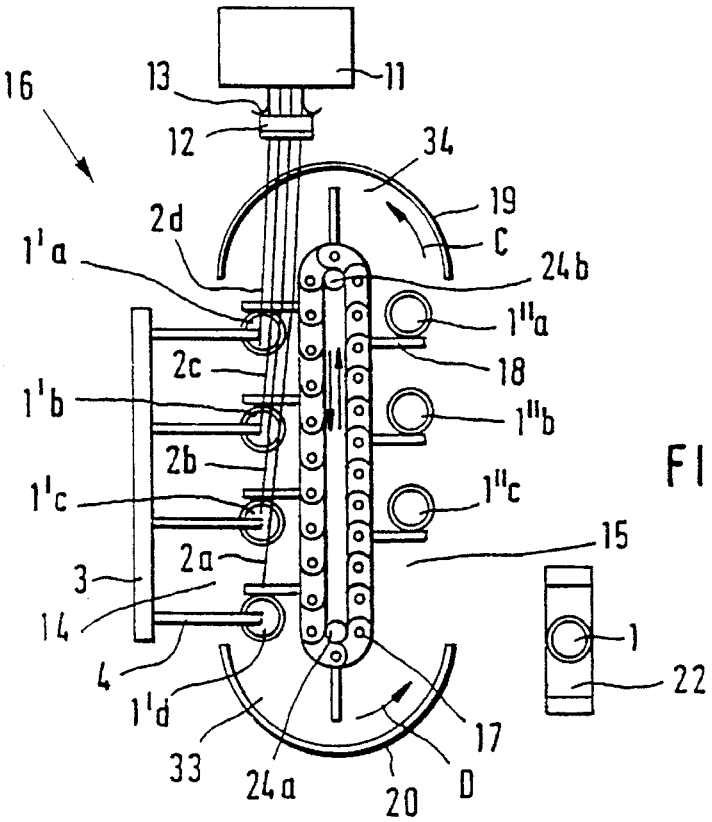
FIG. 3 is a schematic top plan view illustrating details of a preferred embodiment according to the invention.

Also referring to FIG. 3, in the apparatus for advancing the slivers 2*a*, 2*b*, 2*c* and 2*d* to the drawing frame 11, each sliver runs from its respective coiler can to a common intake roll 12 which is adjoined downstream by a sliver guide 13 through which the slivers are introduced into the drawing frame 11.

Figure 4:
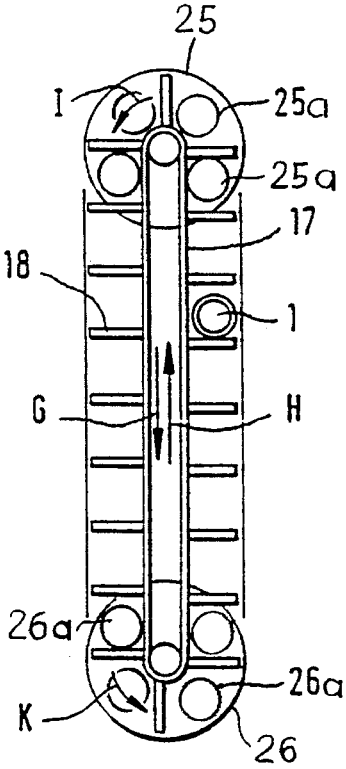
FIG. 4 is a schematic top plan view of a variant of FIG. 3.

The four coiler cans 1'*a*, 1'*b*, 1'*c* and 1'*d* from which sliver is momentarily taken to the drawing frame 11 are positioned in a row in a channel 14. Parallel to the channel 14 a channel 15 is provided which receives empty or full coiler cans 1"*a*, 1"*b*, 1"*c*. For the coiler cans a can advancing system 16 is provided which has an endless circulating transporting chain 17 on which can pusher arms 18 are mounted. The chain 17 travels in the direction of arrows G, H, as shown in FIG. 4. Each pusher arm 18 engages a respective coiler can for advancing the same. As holding elements two guide rails 19 and 20 are provided which guide and restrain the coiler cans at the locations of reversal along an arcuate path as indicated by arrows C and D to thus prevent the coiler cans from leaving their arcuate path, for example, in response to centrifugal forces. Externally of the zone of the reversal locations the pusher arms 18 push the coiler cans linearly in opposite directions A and B.

Figure 2:
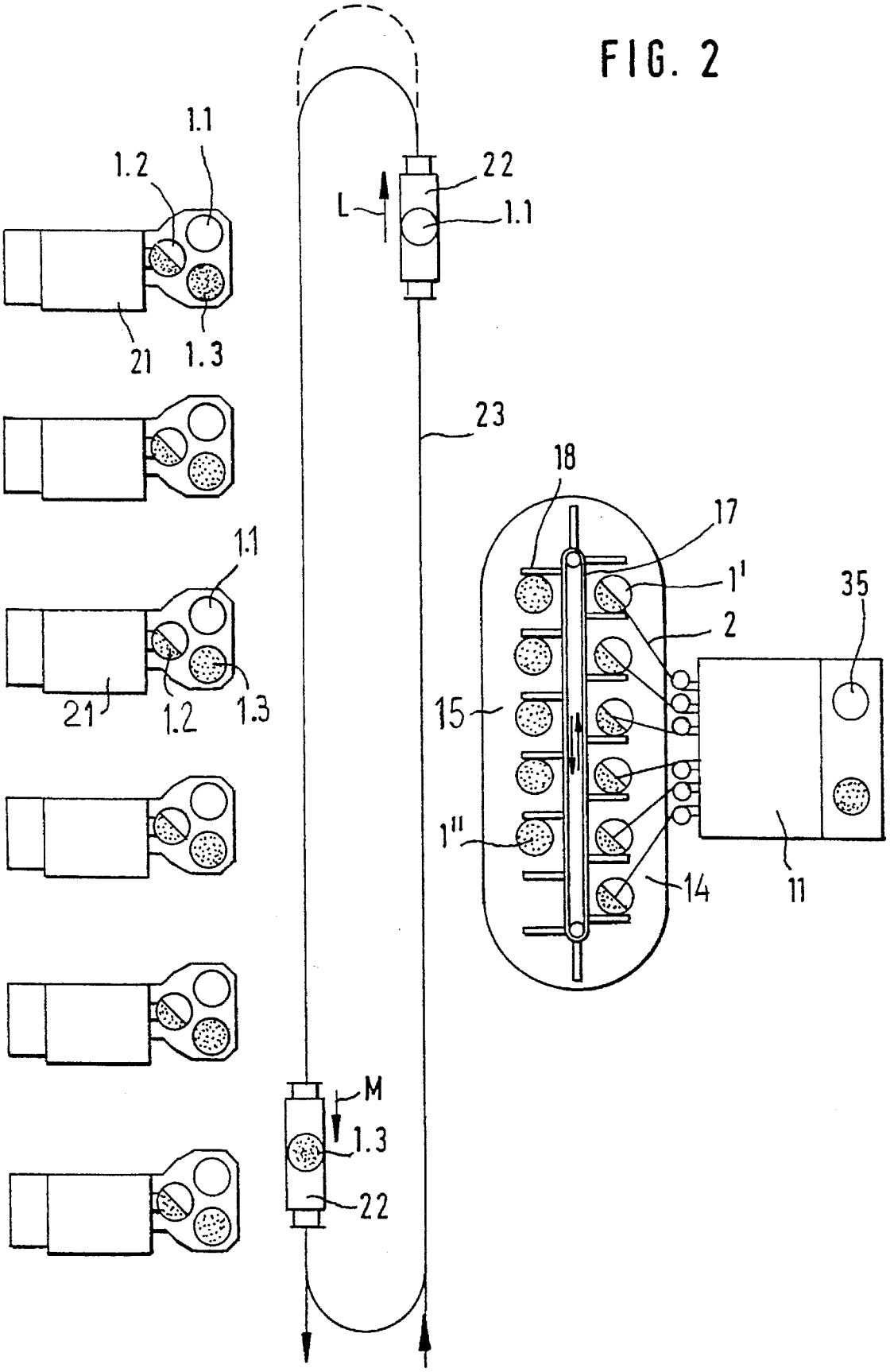
FIG. 2 is a schematic top plan view of a drawing frame, utilizing an apparatus according to the invention wherein the drawing frame is coupled to carding machines by a transporting device and wherein the can inlet rack extends perpendicularly to the direction of sliver feed into the drawing frame.

FIG. 2 illustrates a plurality of carding machines 21 arranged in a single row. Each carding machine 21 produces sliver which is deposited by a sliver coiler in cans positioned at the output side of the respective carding machine. Each carding machine is associated with three coiler cans: the cans 1.2 momentarily receive sliver and are in a partially filled state. After a can has been fully charged with sliver, it assumes the position designated at 1.3 from which position the full coiler can is transferred to a transport device 22 and is carried from the respective carding machine 21 to the intake side of the drawing frame 11. At each carding machine the empty cans (waiting to be shifted into the sliver-receiving position) are designated at 1.1.

The transport device 22, such as a driverless carriage, has a receiving surface for one or more coiler cans and travels along a track 23. For this purpose, the carriage 22 has a drive controlled by a non-illustrated control device. The transport carriage 22 has a non-illustrated can-shifting device which transfers coiler cans onto or from the carriage 22. The fully charged cans 1.3 first have to be moved from the working position at the outlet of the cards 21 into a removal position. Then the full cans 1.3 are, at the transfer position in the zone of the carding machines 21, transferred to the carriage 22 by means of the can-shifting device. Thereafter, the carriage 22 travels to the intake side of the drawing frame 11 where an intake table with an intake rack 3 is provided in which a standby position, a removal position and a working position (channel 14) is provided. In the illustrated embodiment the intake table is designed for receiving in each instance six coiler cans 1' arranged in a row in the working position and six coiler cans 1" in a standby position (fully charged cans) or, as the case may be, in the removal position (empty cans).

The can advancing system 16 serves to move the cans 1', 1" from the standby position in the channel 15 into the working position in the channel 14 or conversely. At the transfer position in the channel 15 the empty cans are moved from the removal positions to the transport carriage 22 by the can shifting device of the carriage 22, for example, a shiftable can gripper. The carriage 22 may then transport the empty can to a transfer position situated at the carding machines 21 and transferred to the standby position. The sliver 2 fed into the drawing frame 11 from the coiler cans 1' situated in the working position in the channel 14 is discharged as a doubled and stretched sliver in the flat cans 9.

The activities of the carriage 22 are controlled by a master computer which transmits commands to a control device of the carriage 22 to execute transporting tasks such as moving full or empty cans into the standby positions in the channel 15 or removing cans 1 from the removal position situated at the cards 21 and the drawing frame 11. The master computer is connected with a first signal transmitter which is situated at the input side of the drawing frame 11 and which reports when the coiler cans 1' are about to run out of sliver in the working position in the channel 14. At the standby positions and removal positions of the inlet side of the drawing frame sensors (optical barriers or contact switches) are provided which report the presence of the coiler cans and which toot are connected with the master computer. In the zone of the outlet side of the carding machines 21 further signal transmitters are provided which indicate in advance when the cans 1.2 in the working position are fully charged with sliver. The signal transmitters of the carding machines 21 are in principle of the same construction as the signal transmitters associated with the drawing frame 11. Further, in the standby positions of the coiler cans sensors (optical barriers or contact switches) are provided which indicate the presence of standby cans. The signal transmitters and the sensors of the carding machines 21 are also connected to the master computer.

According to the invention, the endless circulating transporting chain 17 is intermittently operated in such a manner that the replacement of a plurality of depleted cans 1' at the intake of the drawing frame 11 on channel 14 are replaced "blockwise" with the full cans 1" that dwell in the standby position on channel 15 after having been brought there, individually or in groups, by the transport carriage 22 from the carding machines 21. The "blockwise replacement" or "block exchange" means that rather than individually replacing depleted cans 1' with a full can 1", all the cans 1' from which sliver is being taken by the drawing frame 11, are replaced in a single operation, for example, at a time when one of the cans 1' is about to be depleted, without regard to the fill level of the other cans 1'.

Figure 2A:
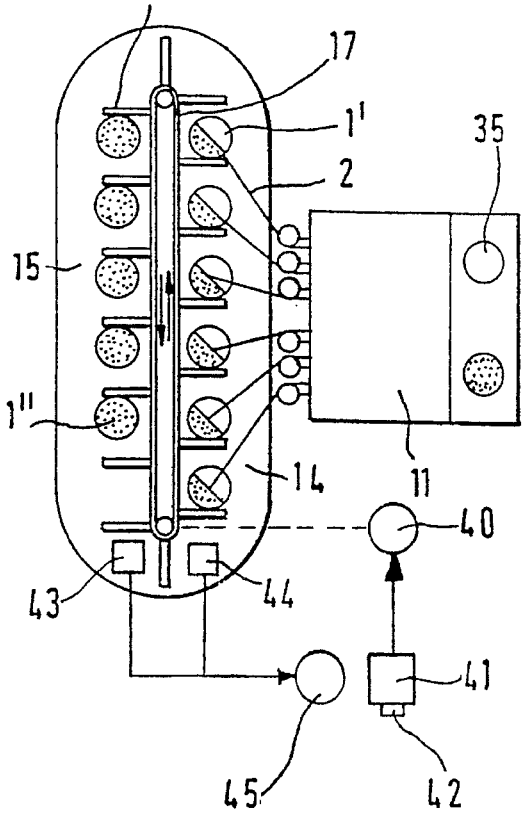
FIG. 2*a* is a schematic top plan view of one part of FIG. 2, with block diagram illustrating a manual operational control.
Figure 2B:
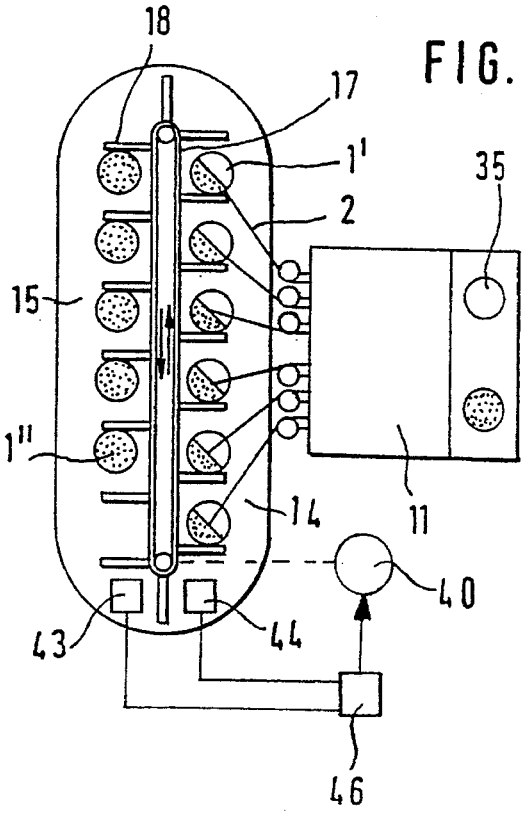
FIG. 2*b* is a schematic top plan view of one part of FIG. 2, with block diagram illustraing an automatic operational control.

For performing such a "block exchange" operation, reference is made to FIGS. 2*a* and 2*b*.

In FIG. 2*a*, the chain 17 is circulated by a motor 40 which may be started and stopped from a control panel 41 by operating, for example, a pushbutton 42. Thus, in its simplest implementation the intermittent cycling of the chain 17 may be effected by an operating person who visually observes the fill level of the six cans 1' from which sliver is simultaneously pulled by the drawing frame 11. At the same time, the operating person also visually determines whether all six standby positions have been filled by full cans 1". Thus, when it is observed that one of the cans 1' is about to run out of sliver and further, the operator has determined that all the standby positions have been occupied by a full can 1", he presses the pushbutton 42 to initiate a running cycle of the motor 40. During such cycle the transporting chain 17 will run through the distance between the longitudinal chain ends so that all the cans 1' will travel from the channel 14 to the channel 15 to assume a standby position (waiting for removal by the transporting carriage 22) and all the full cans 1" will travel from the channel 15 to the channel 14 so that the drawing frame may start receiving sliver simultaneously from full cans. The operating cycle of the motor 40 may be stopped by the operator by releasing the pushbutton 42 or such stoppage may be effected automatically when all six cans 1' have moved out of the channel 14 into the channel 15 and, at the same time, all full cans 1" have moved out of the channel 15 into the channel 14.

Instead of a direct visual observation of the channels 14 and 15 by the operating person to determine the fill level of the cans 1' and the presence or absence of full cans in the channel 15 first and second sensor assemblies 43 and 44 may be used. The first sensor assembly 43 generates a signal when, for example, all standby positions on the channel 15 are occupied by a full can 1" and the second sensor assembly 42 emits a signal when, for example, one of the cans 1' in use is about to be depleted. The two signals originating from the first sensor assembly 43 and the second sensor assembly 44 may be combined by an AND gate whose output signal may generate a visual or audio signal indicating to the operating person that at least one can 1' is about to be depleted and all standby positions in channel 15 are occupied by a full can 1". Such a condition signals to the operating person to set in motion the motor 40 to perform an operating cycle.

It is to be understood that the above-described batch exchanging operation may be partially or fully automated as shown in FIG. 2*b*, for example, by eliminating the manual pushbutton operation and the display device 45 and by applying the signals, generated by the first and second sensor assemblies 43 and 44 to a motor control 46 (which may include an AND gate) which, in turn, applies operating signals to the motor 40, thus eliminating the need of an operating person for cycling the transporting chain 17. It is noted that such an automatic operation may be controlled by a master computer which also controls delivery of full and empty cans by the carriage 22 between the carding machines 21 on the one hand and the drawing frame 11 on the other hand.

Reverting to FIG. 3, the conveyor chain 17 circulates about two spaced vertical axles 24*a* and 24*b*. The parallel-arranged linear tracks (channels) 14 and 15 are interconnected at adjoining opposite ends by a semicircular track bounded by respective semicircular guide rails 19 and 20.

In the embodiment illustrated in FIG. 4, at opposite ends of the parallel-extending linear tracks 14 and 15 circular platforms 25 and 26 are arranged at floor level for rotation in the direction of arrows I and K about the respective, vertically oriented axis of axles 24*a*, 24*b*. For stabilizing the cans to thus prevent them from leaving the curvilinear track, for example, because of centrifugal forces, the platforms are provided with circular depressions 25*a*, 26*a* accommodating the can bottoms.

Turning to FIGS. 5*a* and 5*b*, at the outer end of the can pusher arms 18*a*, spring-loaded arms 27 are mounted by means of respective rotary bearings 28 to allow swinging motion of each arm 27 in a horizontal plane as indicated by the arrows E and F. The outer end of each arm 27 is provided with a roller 29. The diameter d of the cans 1 is greater than the distance a between the end of a roller 29 and the successive pusher arm 18*b* so that the can 1*a* may enter into or leave the space between two pusher arms 18*a* and 18*b* only after overcoming the force of the compression spring 36 biasing the arm 27.

In the arrangement according to FIG. 5*a*, each coiler can has travelling rollers 30 at the underside of the can bottom. In case coiler cans 1 without travelling rollers are used, then, according to FIG. 6, at least the channels 14 and 15 have, as a transporting mechanism, a roller track 32.

It will be understood that the above description of the present invention is susceptible to various modifications, changes and adaptations, and the same are intended to be comprehended within the meaning and range of equivalents of the appended claims.

What is claimed is:

1. An apparatus for advancing sliver-filled coiler cans into a position at a sliver-intake side of a drawing frame and for removing empty coiler cans from said position; the apparatus comprising (a) an endless track including (1) a first track portion including said position and structured to accommodate a first plurality of coiler cans;

(2) a second track portion structured to accommodate a second plurality of coiler cans; said first and second track portions extending generally side by side;

(3) two arcuate deflecting track portions interconnecting said first and second track portions at opposite ends thereof;

(b) an endless circulating transporting chain extending along said endless track;

(c) a plurality of spaced pusher arms mounted on the chain and extending therefrom to individually engage a coiler can and advancing each can on said endless track as the chain circulates, whereby said pusher arms advance the coiler cans on said first track portion in a first direction and on said second track portion in a second direction; said first and second directions being opposite to one another; said spaced pusher arms defining at all times a plurality of can positions for said first plurality of coiler cans on said first track portion and a plurality of can positions for said second plurality of coiler cans on said second track portion;

(d) can retaining means for preventing the cans from leaving the deflecting track portions during travel thereon;

(e) a motor connected to the transporting chain for circulating said transporting chain; and (f) motor actuating means for intermittently initiating consecutive operating cycles of said transporting chain such that during each operating cycle the first plurality of coiler cans positioned on said first track portion is moved as a single batch to said second track portion and the second plurality of coiler cans positioned on said second track portion is moved as a single batch to said first track portion.

2. The apparatus as defined in claim 1, wherein said deflecting track portions are semicircular.

3. The apparatus as defined in claim 1, wherein said first and second track portions comprise first and second channels, respectively; the coiler cans being accommodated in said channels.

4. The apparatus as defined in claim 1, wherein said endless track includes a conveying device; said cans being positioned upright on said conveying device.

5. The apparatus as defined in claim 4, wherein said conveying device comprises a roller track.

6. The apparatus as defined in claim 4, wherein said conveying device comprises a conveyor belt.

7. The apparatus as defined in claim 1, wherein said can retaining means comprises a holding element movably mounted on each said pusher arm at an outer end thereof.

8. The apparatus as defined in claim 7, further comprising springs for biasing said holding elements.

9. The apparatus as defined in claim 7, further comprising a rotary bearing pivotally securing each said holding element to a respective said pusher arm.

10. The apparatus as defined in claim 7, wherein each said holding element has an outer end remote from the pusher arm to which it is secured; further comprising a roller mounted on said outer end of said holding element.

11. The apparatus as defined in claim 7, wherein said holding elements are leaf springs.

12. The apparatus as defined in claim 1, wherein said transporting chain circulates about two spaced vertical axles.

13. The apparatus as defined in claim 12, wherein said deflecting track portions each comprise a rotary platform for supporting the coiler cans; each said rotary platform being concentric with a respective said vertical axle.

14. The apparatus as defined in claim 12, wherein said can retaining means comprises an arcuate guiding element supported stationarily at each said deflecting track portion and arranged concentrically to a respective said vertical axle.

15. The apparatus as defined in claim 14, wherein said arcuate guiding element comprises a guiding rail.

16. The apparatus as defined in claim 1, wherein said deflecting track portions each comprise a rotary platform for supporting the coiler cans.

17. The apparatus as defined in claim 16, wherein said can retaining means comprise depressions in said rotary platforms for fittingly accommodating bottom parts of the coiler cans.

18. The apparatus as defined in claim 16, wherein the rotary platforms move in synchronism with said transporting chain.

19. The apparatus as defined in claim 18, wherein said can retaining means is provided on said rotary platforms for stabilizing the cans thereon.

20. The apparatus as defined in claim 1, further comprising sensor means for emitting a first signal representing a presence of filled cans on said first track portion and emitting a second signal for representing a state of depletion of at least one can on said second track portion.

21. The apparatus as defined in claim 20, further comprising display means connected to said signal means for indicating a simultaneous presence of both said first and second signals.

22. The apparatus as defined in claim 1, wherein said motor actuating means comprises (a) sensor means for emitting a first signal representing a presence of filled cans on said first track portion and emitting a second signal for representing a state of fill of cans on said second track portion; and (b) means connecting said sensor means with said motor for initiating an operating cycle of said transporting chain upon a simultaneous presence of said first and second signals.

* * * * *